US005797491A

United States Patent [19]

Fierek et al.

[11] Patent Number: 5,797,491

[45] Date of Patent: Aug. 25, 1998

[54] TOOL CARRIER-ORGANIZER

[75] Inventors: David P. Fierek, Mounds View; Jack J. Hubert, Duluth, both of Minn.

[73] Assignee: Fiskars Inc., Madison, Wis.

[21] Appl. No.: 643,176

[22] Filed: May 6, 1996

[51] Int. Cl.[6] ..... B65D 30/22; B65D 39/16

[52] U.S. Cl. ..... 206/373; 383/38; 383/104

[58] Field of Search ..... 206/372, 373; 383/38, 39, 40, 104, 76

[56] References Cited

U.S. PATENT DOCUMENTS

| | | | |
|---|---|---|---|
| D. 222,951 | 2/1972 | Stringer . | |
| D. 290,064 | 6/1987 | Whitaker . | |
| D. 355,062 | 1/1995 | Maire et al. . | |
| 413,526 | 10/1889 | Light . | |
| 731,378 | 6/1903 | Luther | 383/76 |
| 1,249,439 | 12/1917 | McCoy . | |
| 1,681,922 | 8/1928 | Boch | 383/39 |
| 2,594,176 | 4/1952 | Kaiser, Jr. . | |
| 2,758,798 | 8/1956 | Schmidt . | |
| 2,778,398 | 1/1957 | Edwards . | |
| 2,899,997 | 8/1959 | Rauen . | |
| 3,967,666 | 7/1976 | Farrar . | |
| 4,356,854 | 11/1982 | McGee . | |
| 4,646,804 | 3/1987 | Damiano . | |
| 4,715,499 | 12/1987 | Franklin . | |
| 4,750,639 | 6/1988 | Schaerer | 383/38 |
| 4,765,472 | 8/1988 | Dent . | |
| 4,826,007 | 5/1989 | Skeie . | |
| 4,977,941 | 12/1990 | Henderson . | |
| 4,993,551 | 2/1991 | Lindsay . | |
| 5,174,447 | 12/1992 | Fleming . | |
| 5,186,329 | 2/1993 | Fogelberg . | |
| 5,190,377 | 3/1993 | Kelly . | |
| 5,429,265 | 7/1995 | Maire et al. . | |

FOREIGN PATENT DOCUMENTS

| | | | |
|---|---|---|---|
| 1544625 | 4/1979 | United Kingdom | 383/38 |

OTHER PUBLICATIONS

1995 Portable Products, Inc. Catalog at pp. 1,3,5,6 & 9.

*Primary Examiner*—Paul T. Sewell
*Assistant Examiner*—Anthony Stashick
*Attorney, Agent, or Firm*—Foley & Lardner

[57] ABSTRACT

A compact and readily transportable tool carrier-organizer of the type made of soft fabric material includes a parts organizer in the form of a receptacle having several partitions creating a plurality of compartments. The parts organizer is associated with a tool carrier comprising several pockets formed on the outside surface of the organizer. The pockets of the carrier are of gradually increasing height along the circumference of the carrier to conveniently accommodate tools of different heights. The pockets may also be of varying width.

27 Claims, 6 Drawing Sheets

TOOL CARRIER-ORGANIZER

FIELD OF THE INVENTION

The present invention relates generally to tool cases or boxes, and in particular to those made of soft fabric material.

BACKGROUND OF THE INVENTION

Tool cases or boxes used to organize, store, and transport hand tools and parts are widely used by tradesmen and by those who prefer to handle by themselves repair and improvement projects around the home. These prior art tool boxes which are commonly made of steel, plastic or other suitable materials, typically comprise several compartments of various dimensions in which the tools and parts are stored. However, conventional tool boxes are typically sturdy and therefore heavy, even when empty, as they need to be sufficiently strong to store and transport bulky hand tools and preferably a minimum assortment of parts.

Those skilled in the art have recognized the obvious shortcomings of these conventional tool boxes. As a result, to reduce their weight without compromising their required ruggedness, more recent prior art tool boxes have been made out of strong fabric-type materials. In that case, however, an armature or support structure of suitable structural integrity is required.

For example, certain more recent prior art tool boxes or carriers have been adapted for use with a plastic pail or bucket. These tool carriers generally consist of a sleeve provided with multiple pockets or compartments designed to store various hand tools. The sleeve is draped, in saddle-type fashion, over the rim of a plastic bucket such as an empty five-gallon spackling pail. A tool carrier of this sort is illustrated in U.S. Pat. No. 5,429,265 issued Jul. 4, 1995 to Maire et al.

While bucket supported tool carriers are significantly lighter than their older and more conventional toolbox counterparts, they do not typically include a convenient way to store small parts. These small parts such as nails, screws, washers, wire nuts, pipe fittings, etc., will most commonly be stored in small containers such as baby food jars, cans or cardboard boxes, which are then placed inside the large bucket. As one can readily appreciate, however, when the bucket-mounted tool carrier is transported to and from the job site, these small containers will naturally fall to the bottom of the bucket, thereby making it difficult to retrieve these items. This operation will often require the user to empty the entire bucket to find the particular jar containing the needed small parts.

Additionally, for small jobs particularly around the home, bucket-mounted tool carriers are often too bulky, thereby making their use less convenient. Since bucket-mounted tool carriers commonly use a five-gallon plastic pail to support the carrier, they do not satisfactorily conform to irregular floor surfaces and therefore require a levelled area at least the size of the bottom of the bucket for the tool carrier to remain upright. They also require a relatively large space for storage. Finally, in use, the user must take adequate precautions when placing the tool carrier on the floor to avoid scratching delicate floor surfaces.

Various efforts have therefore been made to palliate the shortcomings of bucket-mounted tool carriers. Specifically, two handy parts organizers are illustrated at page 9 of the 1995 catalog of the Portable Products Division of the assignee of the present invention. These organizers, which are made of suitable soft fabric material, typically require less care by the user when moved across certain floor surfaces. The Portable Products organizers are provided with several compartments in which various small parts are conveniently stored. These parts organizers are also sized so as to be advantageously received in an ordinary five gallon pail. Draw strings which are looped around portions of the periphery of the organizer and through individual partitions also allow the user to close the parts organizer by simply lifting it.

Another way to store small parts is disclosed in U.S. Pat. No. 4,826,007 issued May 2, 1989 to Skeie, in which the parts organizer is combined with the tool carrier. However, the Skeie tool carrier-organizer suffers from a number of imperfections. Namely, in Skeie the tools are organized inside the bucket, thereby making it difficult for the tradesman to reach them. In addition, the compartments that receive the parts must be individually closed, making the use of this carrier-organizer less convenient as, at times, one will preferably make sure that all of the compartments are closed before moving the tool carrier-organizer. Furthermore, because the parts organizer is associated with a relatively tall tool carrier, it is prone to tipping over.

In light of the foregoing, not only is it desirable in many cases to combine a toolbox or carrier with a parts organizer, there appears to be a need for a novel tool carrier-organizer that can alleviate the problems that are still characteristic of conventional carriers and organizers. Namely, it is desirable to provide a new compact tool carrier-organizer that has a low center of gravity and that can adequately conform to irregular floor surfaces so that it is less prone to being tipped over. The new carrier-organizer should also be relatively light while sturdy, convenient to transport, but configured so that the tools and parts are readily accessible to the user. Nevertheless, all of these desirable features preferably need to be embodied in a tool carrier-organizer which is not prohibitively expensive.

SUMMARY OF THE INVENTION

A tool carrier-organizer according to the present invention is made of self-supporting fabric-type material. According to one aspect of the invention, the carrier-organizer includes a parts organizer in the form of a receptacle having several partitions creating a plurality of compartments; the parts organizer is provided with draw strings to automatically close the organizer when it is lifted by the user in a one handed motion. The parts organizer is associated with a tool carrier in the form of pockets formed on the outside surface of the organizer.

According to a preferred embodiment of the invention, the outer pockets of the carrier are of gradually increasing height along the circumference of the carrier to conveniently accommodate tools of different lengths. The pockets may also be of varying width.

A tool carrier-organizer according to the present invention is compact and easy to transport, it is of relatively light weight, it has a low center of gravity, and it makes tools and parts readily accessible to the user.

Other advantages of the invention will become apparent from the detailed description given hereinafter. It should be understood, however, that the detailed description and specific embodiments are given by way of illustration only since, from this detailed description, various changes and modifications within the spirit and scope of the invention will become apparent to those skilled in the art.

BRIEF DESCRIPTION OF THE DRAWINGS

The preferred exemplary embodiment of the invention will hereinafter be described in conjunction with the appended drawings, wherein like numerals denote like elements and.

DETAILED DESCRIPTION OF A PREFERRED EXEMPLARY EMBODIMENT

Figure 1:
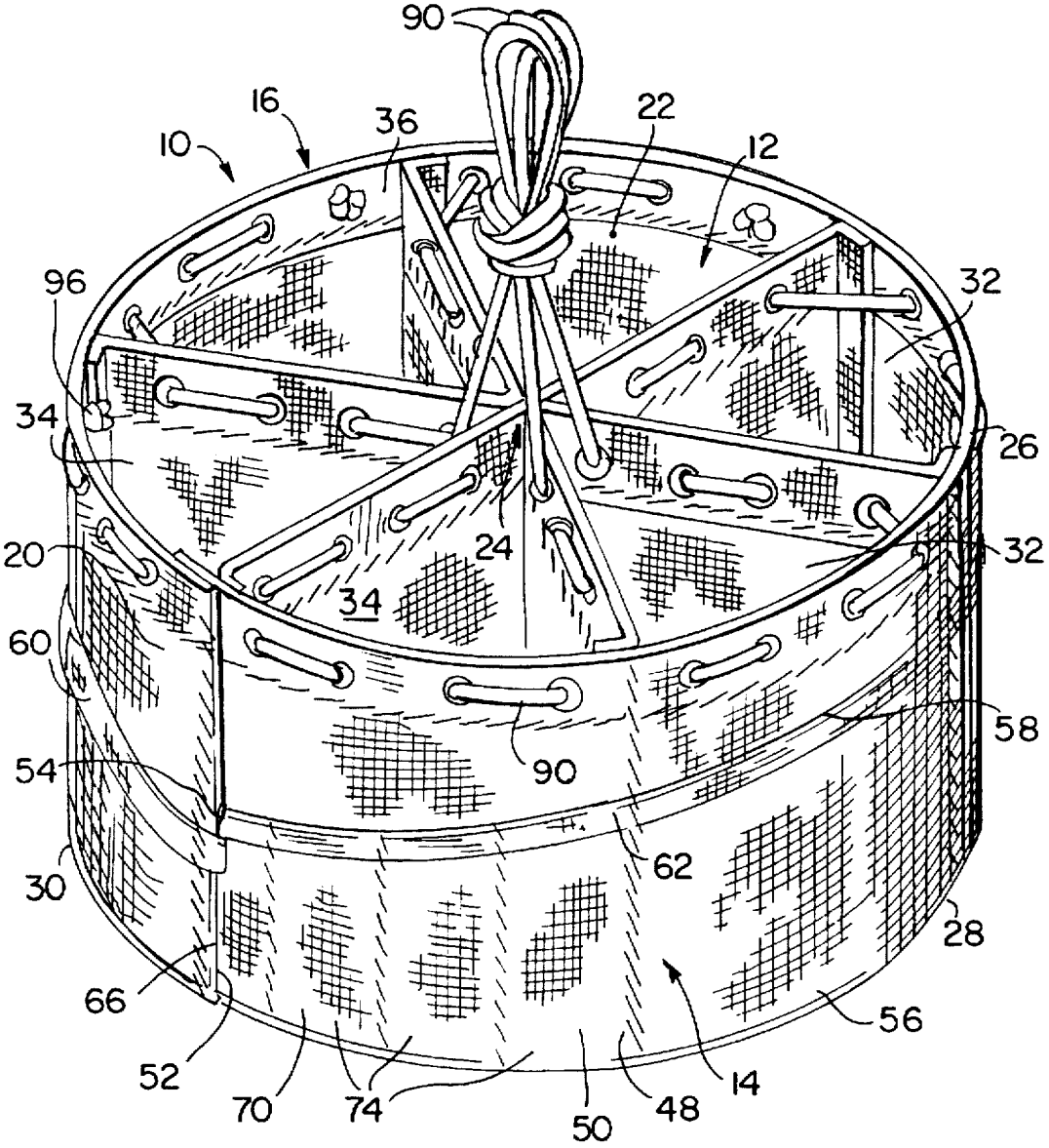
FIG. 1 is a perspective view of a tool carrier-organizer in accordance with a preferred embodiment of the invention, viewed from the rear of the carrier-organizer.
Figure 2:
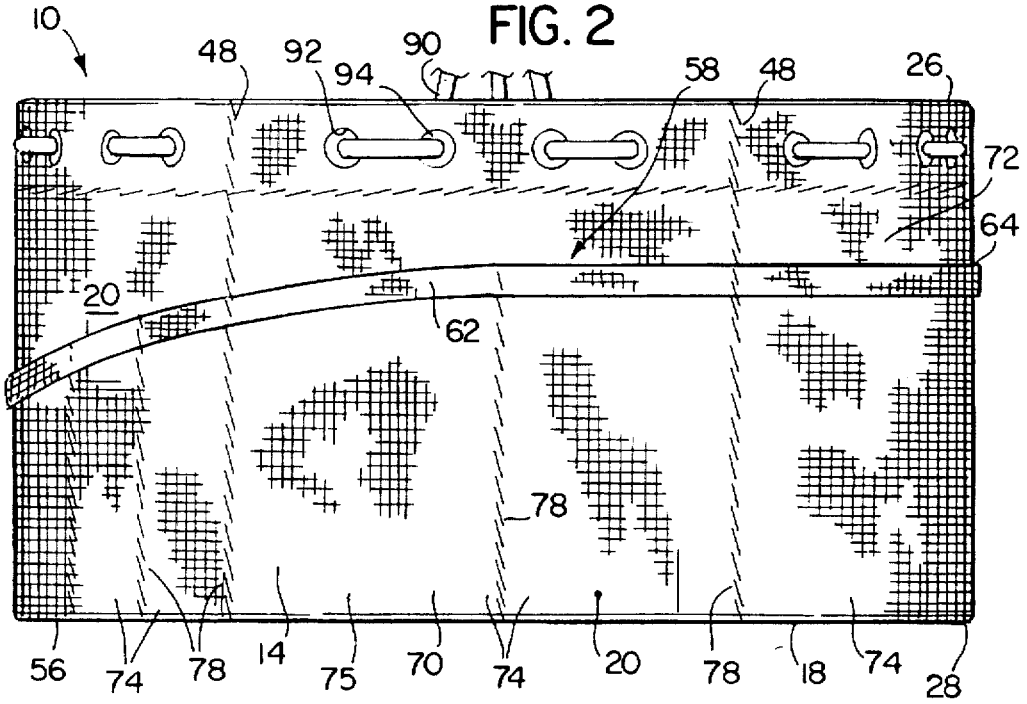
FIG. 2 is a right side elevation view of the carrier-organizer of FIG. 1.

Referring to FIGS. 1–4, a carrier-organizer 10 according to the invention includes a part organizer 12 associated with a tool carrier generally designated as 14. Organizer 12 is formed as a receptacle 16 having a planar bottom surface 18 joined to an upstanding wall or sleeve 20 surrounding a cavity 22. Cavity 22 has a geometric center designated as 24. Wall 20 is bounded by top and bottom edges 26, 28, respectively. In accordance with the invention, organizer 12 is made of soft fabric, wear resistant, material such as canvas or nylon. Specifically, organizer 12 can be made of 6.6 nylon, 600 denier fabric, Cordura® nylon yarn or twine from E. I. Dupont De Nemours & Co., Inc. of Wilmington, Del., or Anso®-tex nylon fiber from Allied Fibers, a Division of Allied-Signal Inc., of Petersburg, Va. Accordingly, by virtue of its inherent flexibility, parts of various configurations will be conveniently nested in organizer 12, and bottom surface 18 will readily conform to irregular surfaces, thereby freeing the user from exercising undue attention when placing organizer 12 on a support surface. Bottom surface 18 and wall 20 will preferably be sewn together, surface 18 being stitched along its periphery 30 to bottom edge 28. Other means to join wall 20 to bottom 18 are, however, also suitable so long as a sturdy receptacle 16 is formed by that process.

Figure 7:
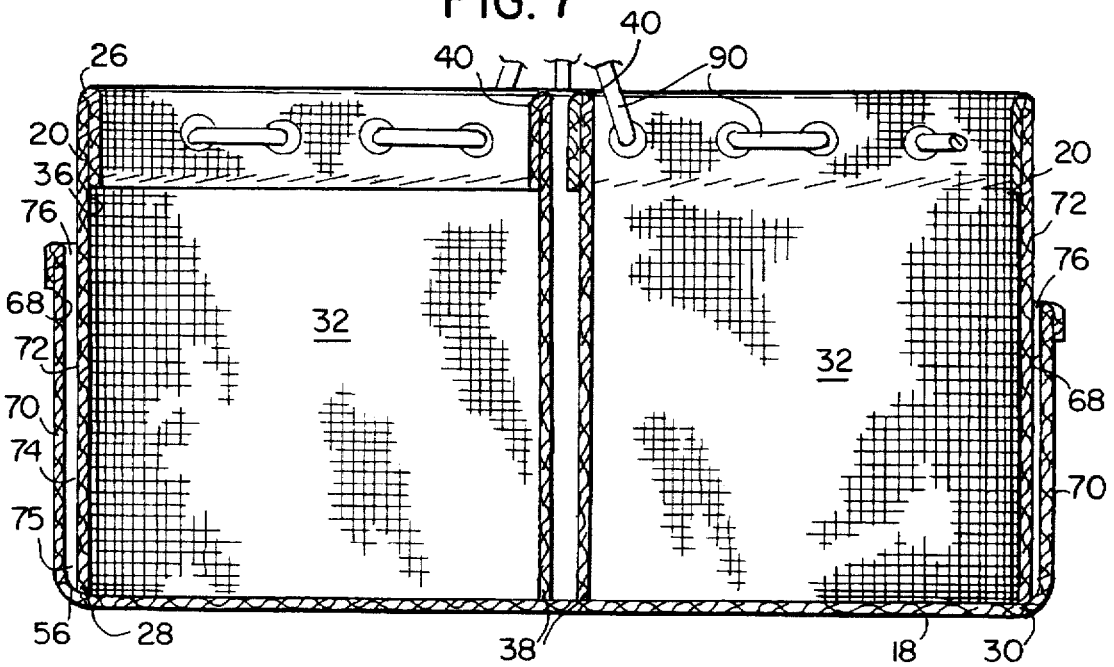
FIG. 7 is a sectional view taken along line 7—7 shown in FIG. 5.
Figure 3:
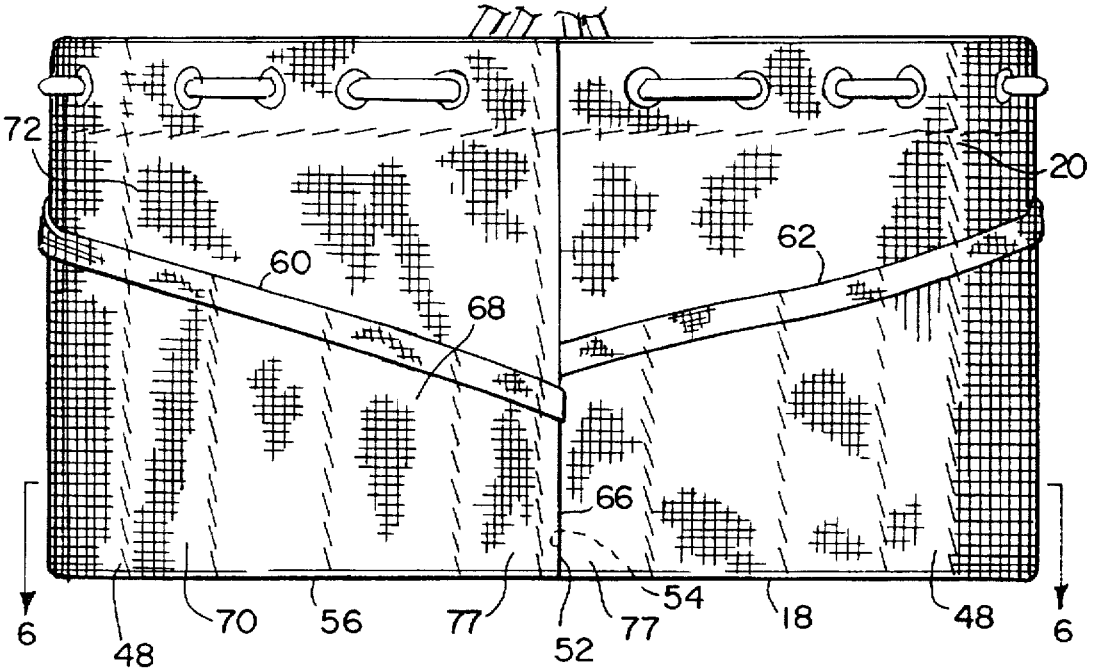
FIG. 3 is a rear elevational view thereof.
Figure 4:
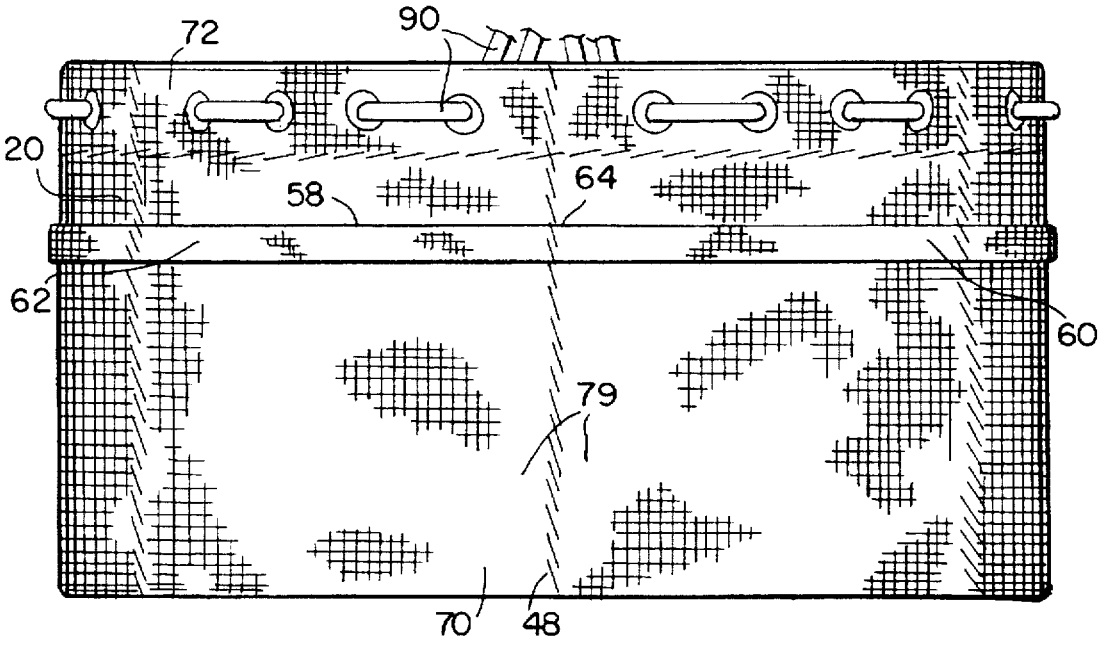
FIG. 4 is a front elevational view thereof.
Figure 5:
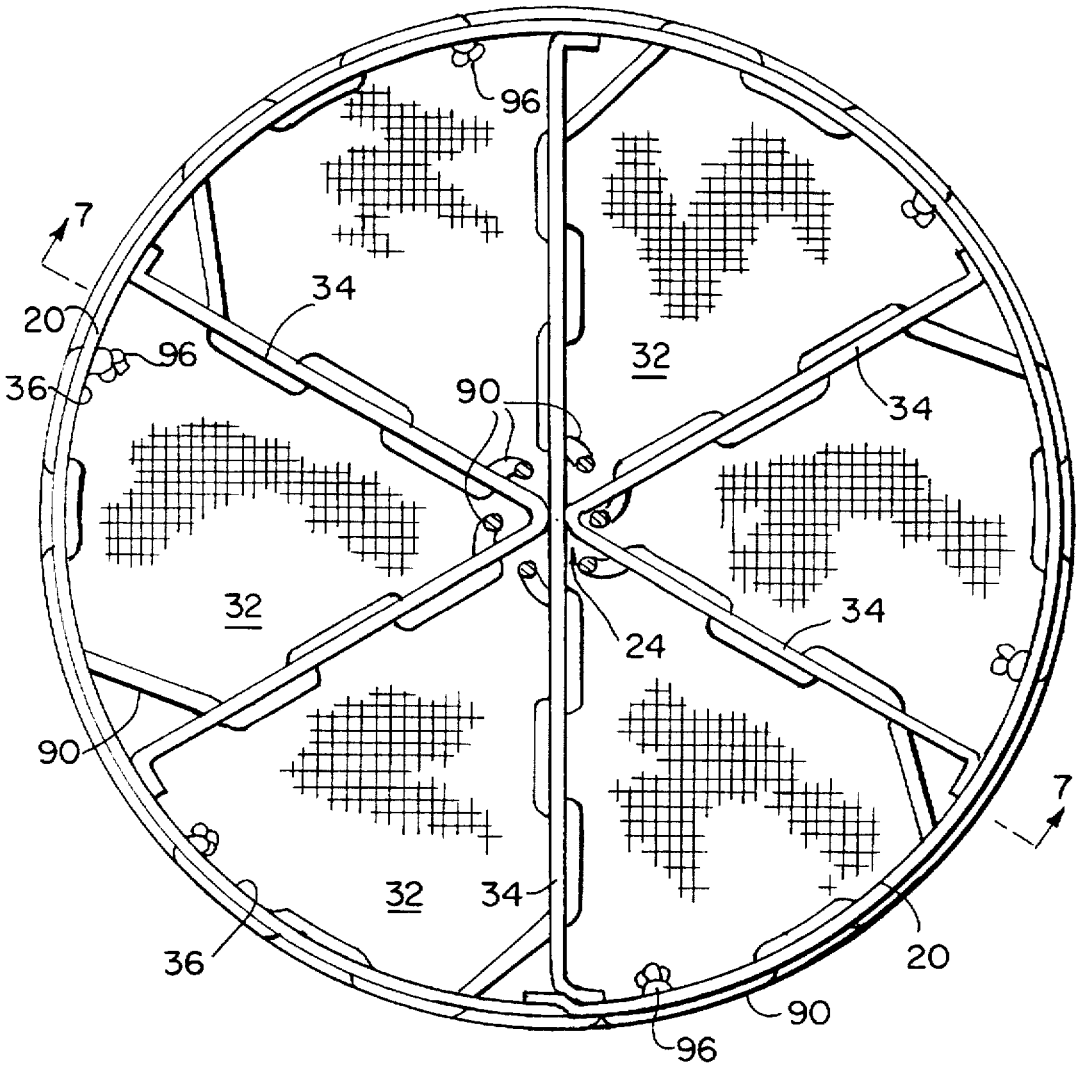
FIG. 5 is a top plan view thereof.
Figure 6:
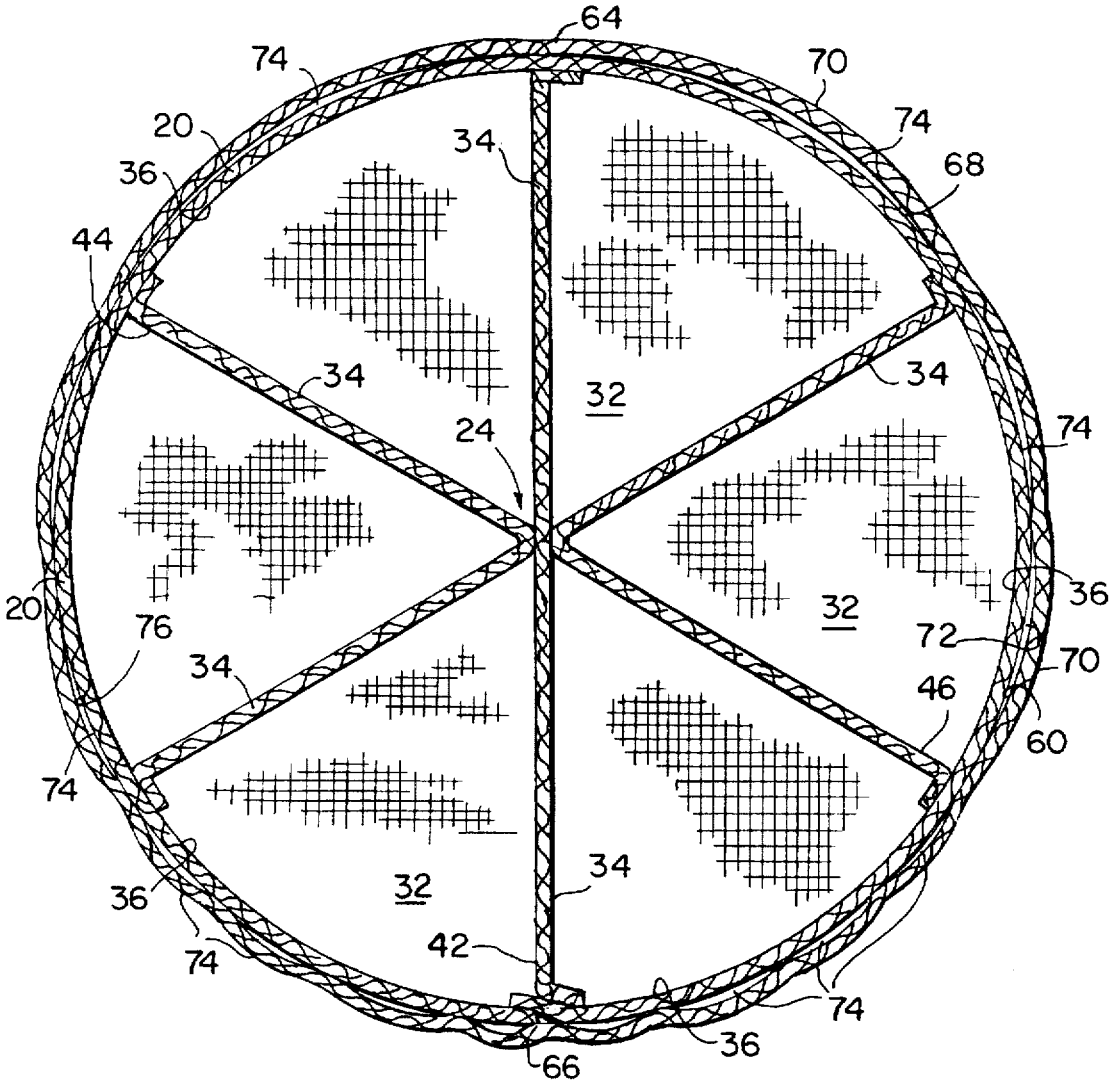
FIG. 6 is a sectional view taken along line 6—6 shown in FIG. 3.

Referring now to FIGS. 5–7 also, cavity 22 includes a plurality of pie-shaped compartments generally designated as 32, radially extending from center 24. Each compartment 32 comprises a pair of web panels generally designated as 34 extending from inner surface 36 of wall 20. Each panel is bounded by a lower margin 38 and an upper margin 40. Conveniently, in a six-compartment organizer, compartments 32 can be formed by three blanks of fabric 42, 44, and 46, as shown in FIGS. 1, 5, and 6. In that case, blank 42 extends diametrically across cavity 22 while two other blanks 44, 46, are folded midway along their lengths to form an acute included angle about center 24. The mid-points of all three blanks are then joined together at 24 such as by stitching, while the distal ends of the blanks are attached to inner surface 36 along stitching lines 48. Preferably, stitching lines 48 extend along the entire height of the blanks, from lower margin 38 to upper margin 40.

In the preferred embodiment of the present invention, tool carrier 14 is formed of a polygonal blank designated as 50 being bounded by a pair of substantially parallel first and second side edges 52, 54, a lower edge 56, and an upper edge 58. Upper edge 58 includes two sides 60, 62 extending upwardly from side edges 52, 54, respectively, and meeting in an apex region 64 lying substantially diametrically across a seam 66 where side edges 52, 54 meet. Blank 50 also comprises oppositely facing inner and outer faces, 68, 70, respectively. In accordance with the preferred embodiment of the invention, carrier 14, like organizer 12, is made of soft fabric, wear resistant, material such as canvas or nylon, for example 6.6 nylon, 600 denier fabric, Cordura® or Anso® nylon fibers.

Organizer 12 also includes an outer surface 72 spaced apart from, and oppositely facing, inner surface 36. Lower edge 56 of blank 50 is attached to outer surface 72 of organizer 12 along bottom edge 28 of wall 20, with the inner face 68 of blank 50 facing outer surface 72 such as by stitching. Tool carrier 14 also includes a plurality of pockets of varying heights and widths which are generally designated as 74. Each pocket 74 has a bottom 75, advantageously bounded by lower edge 56, and a distal opening 76 directed toward top edge 26 of wall/sleeve 20. The pockets are demarcated widthwise by lines 78 extending between lower edge 56 and upper edge 58 of blank 50. Because in the preferred embodiment of the invention blank 50 is made of fabric-type material, lines 78 are stitching lines, some of which being conveniently and economically formed when attaching web panels 34 to inner surface 36 of wall 20. In such cases, a portion of stitching lines 48 and 78 will be common.

As more particularly illustrated in FIG. 6, pockets 74 vary in width along outer surface 72 of wall 20, from seam 66 to apex region 64, i.e from a base pocket 77, to an apex pocket 79. The width of each pocket 74 will, as one can readily appreciate, be determined depending on the particular application for which carrier-organizer 10 will be used.

While the foregoing description of tool carrier 14 includes forming pockets 74 from a single blank 50 and stitching lines 78, it can be readily appreciated that pockets 74 could be formed from separate pieces of material individually attached along outer surface 72 of wall 20. In such event, each separate piece may be marginally aligned with adjoining pieces. Alternatively, a plurality of blanks 50 can be used, each suitable to form at least one pocket. However, the manufacture of tool carrier 14 using a single blank 50 considerably reduces manufacturing time.

Figure 8:
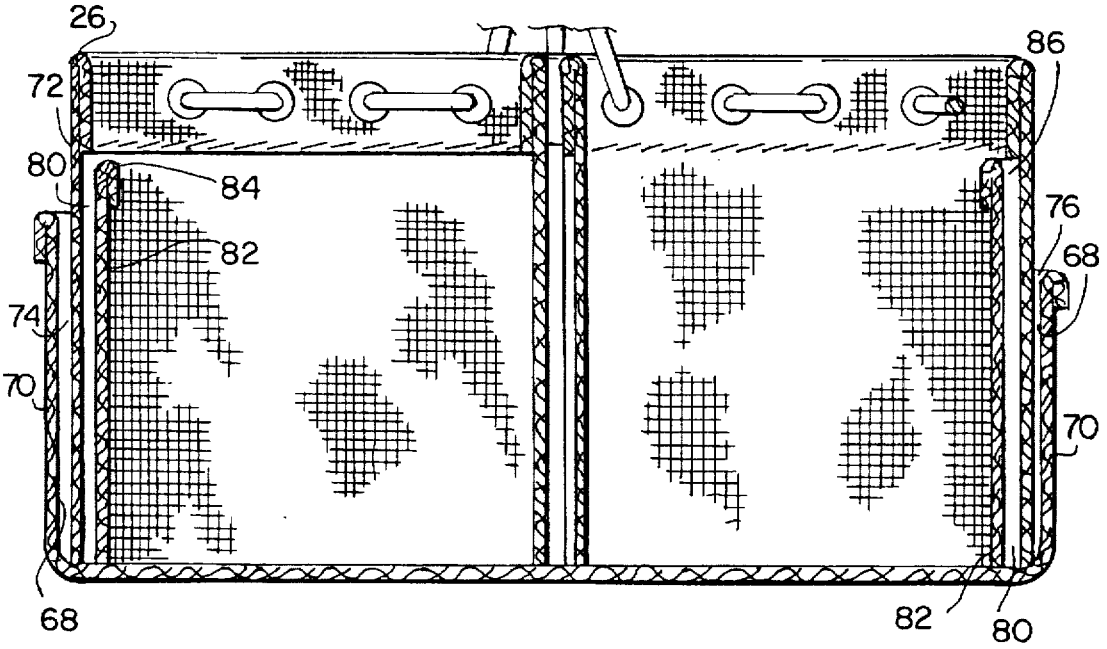
FIG. 8 is a modified sectional view taken along line 7—7 shown in FIG. 5, illustrating pockets formed within the pie-shaped compartments.

Turning now more specifically to FIG. 8, carrier-organizer 10 may also include pockets formed inside compartment 32 such as inner pocket 80. In such cases, additional web panels 82 are attached to inner surface 36 of wall 20, and may be attached to bottom surface 18 as required. Inner pocket 80 has an upper margin 84 thereby defining an opening 86 directed toward top edge 26 of wall 20. Upper margin 84 lies below top edge 26 to facilitate closing parts organizer 12, as will now be explained.

To facilitate carrying carrier-organizer 10 and avoid spilling the parts contained in organizer 12 during its transport by the user, organizer 12 may also advantageously include a closing feature. In the preferred embodiment of carrier-organizer 10, referring more particularly to FIGS. 1–5, 7, and 8, such feature consists of a plurality of pull strings generally designated as 90. Each string 90, which is of desired length, is threaded from along a portion of top edge 26 of wall 20 demarcating a compartment 32 radially through the upper margin 40 of an adjoining web panel 34. String 90 can be threaded through a hem formed in regions of top edge 26 and upper margin 40. Alternatively, string 90 is threaded through apertures 92 formed at spaced intervals along top edge 26 and upper margin 40. For increased durability and improved wear of organizer 14, eyelets 94 are securely received in apertures 92. Necessarily, string 90 is attached to wall 20 by a knot 96.

It is understood that the above description is of a preferred exemplary embodiment of the invention, and that the invention is not limited to the specific forms described. For example, compact tool carrier-organizers in accordance with the invention that are made of soft fabric material and that conveniently combine a tool carrier with a parts organizer could comprise a different number of compartments which could be shorter in height than the organizer. Similarly, the width of the pockets of the tool carrier could be other than as described in connection with the preferred embodiment, depending on the particular application. For example, although the assortment of tools will include tools of varying heights, all tools may be of approximately the same width. In such a case, the carrier-organizer of the present invention will be provided with pockets of substantially the same width. Moreover, even though the preferred embodiment of the invention shows the height of the pockets increasing uniformly around the carrier, this need not be the case. Rather, those skilled in the art will appreciate that the particular pocket configuration, which in certain cases may also include an individual flap to close the pocket opening, can be adapted to suit a particular need without departing from the scope of this invention. Nevertheless, such other constructions are considered to be within the scope of this invention. Accordingly, these and other substitutions, modifications, changes and omissions may be made in the design and arrangement of the elements of the invention disclosed herein without departing from the scope of the appended claims.

We claim:

1. A carrier-organizer comprising:

a. a parts organizer comprising a sleeve made of soft fabric material having oppositely facing inner and outer surfaces and spaced apart top and bottom edges;

a substantially planar bottom surface joined along its periphery to the bottom edge to form a cavity having a center; and a plurality of web panels extending inwardly from the inner surface at spaced intervals along the sleeve, each panel having a lower margin and a distal upper margin, the panels being attached to the bottom surface along the lower margins, the panels being joined at a point located about the center thereby creating a plurality of substantially pie-shaped compartments; and b. a tool carrier formed by a polygonal blank having oppositely facing inner and outer face s, the blank being bounded by generally parallel first and second side edges, a lower edge substantially perpendicular to the first and second side edges, and an upper edge having two sides extending upwardly respectively from the first and second side edges and meeting in an apex region, the first and second side edges being joined together a long a seam;

the lower edge of the blank being attached to the outer surface proximate the bottom edge with the inner face facing the outer surface; and the blank being further attached to the sleeve along lines extending between the blank upper and lower edges, the lines being formed at spaced intervals along the blank upper edge thereby forming a plurality of pockets having openings directed toward the top edge of the sleeve.

2. The carrier-organizer of claim 1, wherein the material is abrasion resistant fabric.

3. The carrier-organizer of claim 1, wherein the carrier-organizer is sized to fit inside a five-gallon bucket commonly used to support a bucket-mounted tool carrier.

4. The carrier-organizer of claim 1, wherein the pockets increase in width from the seam to the apex region.

5. The carrier-organizer of claim 1, further comprising a plurality of pull strings attached to the top edge at spaced intervals therealong and slidably received in regions of the top edge and upper margins, each of the strings extending along a portion of the top edge demarcating a respective pie-shaped compartment and converging toward the center through a respective upper margin so that the carrier-organizer can be closed by pulling the strings.

6. The carrier-organizer of claim 5, wherein the strings are threaded through eyelets attached to the top edge and upper margins.

7. A tool carrier-organizer of the type made of soft fabric material comprising:

a parts organizer comprising a receptacle having a planar bottom-surface joined to a cincturing wall extending upwardly thereof to define a cavity having a center, the wall having spaced apart top and bottom edges and oppositely facing inner and outer surfaces;

at least three panels disposed inside the cavity, each panel having spaced apart upper and lower margins, a mid-point and a pair of distal ends on either side thereof, a first one of the panels being attached at its distal ends to the inner surface in diametrically opposed regions of the cavity, a second and third of the panels being folded at their respective mid-points to form an acute included angle, the second and third panels being attached to the inner surface at their respective distal ends, the panels being joined at their midpoints thereby creating a plurality of substantially pie-shaped compartments; and a tool carrier comprising a polygonal blank having generally parallel first and second side edges, a lower edge substantially perpendicular to the first and second side edges, and an upper edge having two sides extending upwardly respectively from the first and second side edges and meeting in an apex region, the lower edge being attached to the outer surface of the wall proximate the bottom edge, the first and second side edges being joined together along a seam, the blank being further attached to the wall along lines extending between the blank upper and lower edges, the lines being formed at spaced intervals along the blank upper edge thereby forming a plurality of pockets having openings directed toward the top edge of the wall, the pockets increasing in the height from a base pocket to an apex pocket.

8. The carrier-organizer of claim 7, wherein the pockets uniformly increase in height from the base pocket to the apex pocket.

9. The carrier-organizer of claim 7, wherein the pockets uniformly increase in width from the base pocket to the apex pocket.

10. The carrier-organizer of claim 7, wherein the panels are attached to the bottom surface along their lower margins.

11. The carrier-organizer of claim 1, wherein the distal upper margin of each of the panels lies substantially adjacent the top edge.

12. The carrier-organizer of claim 1, wherein each compartment has at least one pocket associated therewith.

13. The carrier-organizer of claim 1, wherein at least one pocket is associated with more than one compartment.

14. The carrier-organizer of claim 1, wherein the plurality of pie-shaped compartments includes a base compartment having an outer surface, the base compartment outer surface comprising a plurality of pockets associated therewith.

15. The carrier-organizer of claim 14, wherein each one of the plurality of pockets associated with the base compartment has a height relatively greater than its width.

16. The carrier-organizer of claim 1, wherein at least one of the pockets further comprises a flap connected to a top region thereof to close the opening of the one of the pockets.

17. The carrier-organizer of claim 1, wherein at least one of the compartments includes an inner pocket formed therewithin.

18. The carrier-organizer of claim 7, wherein the upper margin of each of the panels lies substantially adjacent the top edge.

19. The carrier-organizer of claim 7, wherein each compartment has at least one pocket associated therewith.

20. The carrier-organizer of claim 7, wherein at least one pocket is associated with more than one compartment.

21. The carrier-organizer of claim 7, wherein the apex pocket is formed substantially diametrically across the base pocket.

22. The carrier-organizer of claim 7, wherein the plurality of pie-shaped compartments includes a base compartment having an outer surface, the base compartment outer surface comprising a plurality of pockets associated therewith.

23. The carrier-organizer of claim 22, wherein each one of the plurality of pockets associated with the base compartment has a height relatively greater than its width.

24. The carrier-organizer of claim 7, wherein at least one of the pockets further comprises a flap connected to a top region thereof to close the opening of the one of the pockets.

25. The carrier-organizer of claim 7, wherein at least one of the compartments includes an inner pocket formed therewithin.

26. The carrier-organizer of claim 7, further comprising a plurality of pull strings attached to the top edge at spaced intervals therealong and slidably received in regions of the top edge and upper margins, each of the strings extending along a portion of the top edge demarcating a respective pie-shaped compartment and converging toward the center through a respective upper margin so that the carrier-organizer can be closed by pulling the strings.

27. The carrier-organizer of claim 26, wherein the strings are threaded through eyelets attached to the top edge and upper margins.

* * * * *

UNITED STATES PATENT AND TRADEMARK OFFICE

CERTIFICATE OF CORRECTION

PATENT NO. : 5,797,491

DATED : August 25, 1998

INVENTOR(S) : Dale Schulze et al.

It is certified that error appears in the above-indentified patent and that said Letters Patent is hereby corrected as shown below:

Claim 4, Line 1 of Column 6

Replace: "therebetween, to a closed position for approving the"

With: --therebetween, to a closed position for approximating the--

Signed and Sealed this

Twentieth Day of March, 2001

Nicholas P. Godici

*Attest:*

NICHOLAS P. GODICI

*Attesting Officer*

*Acting Director of the United States Patent and Trademark Office*

UNITED STATES PATENT AND TRADEMARK OFFICE

CERTIFICATE OF CORRECTION

PATENT NO. : 5,797,491
DATED : August 25, 1998
INVENTOR(S) : Fierek et al.

It is certified that error appears in the above-identified patent and that said Letters Patent is hereby corrected as shown below:

Column 5,
Line 51, "face s," should be changed to -- faces, --.
Lines 57 and 58, "a long" should be -- along --.

Signed and Sealed this

Eighteenth Day of December, 2001

*Attest:*

*Attesting Officer*

JAMES E. ROGAN
*Director of the United States Patent and Trademark Office*